US010443345B2

(12) United States Patent
Antonsen et al.

(10) Patent No.: US 10,443,345 B2
(45) Date of Patent: Oct. 15, 2019

(54) METHODS AND SYSTEMS FOR A COMPLEMENTARY VALVE

(71) Applicant: COMITT WELL SOLUTIONS US HOLDING INC., Katy, TX (US)

(72) Inventors: Roger Antonsen, Houston, TX (US); Peter Kris Cleven, Houston, TX (US)

(73) Assignee: Comitt Well Solutions LLC, Katy, TX (US)

( * ) Notice: Subject to any disclaimer, the term of this patent is extended or adjusted under 35 U.S.C. 154(b) by 171 days.

(21) Appl. No.: 15/583,629

(22) Filed: May 1, 2017

(65) Prior Publication Data

US 2018/0313188 A1 Nov. 1, 2018

(51) Int. Cl.
*E21B 34/10* (2006.01)
*E21B 34/06* (2006.01)
*E21B 34/00* (2006.01)

(52) U.S. Cl.
CPC ..... *E21B 34/10* (2013.01); *E21B 34/06* (2013.01); *E21B 2034/007* (2013.01)

(58) Field of Classification Search
CPC .. E21B 23/06; E21B 33/1285; E21B 33/1295; E21B 34/08; E21B 34/14; E21B 2034/007; E21B 34/10
See application file for complete search history.

(56) References Cited

U.S. PATENT DOCUMENTS 2,545,102 A * 3/1951 Miller ..... E21B 47/1025 137/543.17
2,736,383 A * 2/1956 Bedingfield ..... E21B 49/087 166/148
3,163,225 A * 12/1964 Perkins ..... E21B 23/06 166/123
3,376,935 A * 4/1968 Baker ..... E21B 21/10 137/535
3,434,538 A * 3/1969 Pumpelly ..... E21B 23/006 166/123

(Continued)

FOREIGN PATENT DOCUMENTS

WO WO-2017086988 A1 * 5/2017 ..... E21B 33/12

*Primary Examiner* — Jennifer H Gay
(74) *Attorney, Agent, or Firm* — Pierson IP, PLLC

(57) ABSTRACT

A complementary valve (100) for a movable string (1) in a wellbore application, wherein the movable string (1) comprises: a flow activated valve (400) configured to open when a flow through a central bore (2) is less than a predetermined threshold and to close if the flow exceeds the threshold, and a pressure activated device (200, 300) configured to be activated when an activation pressure, defined as the difference between a bore pressure within the central bore (2) and an ambient pressure around the string (1), is greater than or equal to a first activation pressure and to be deactivated when the activation pressure is less than the first activation pressure. The complementary valve (100) is configured to open a fluid connection (111, 121) between the central bore and the ambient wellbore if the activation pressure is less than the first activation pressure, and to close the fluid connection when the activation pressure is equal to or greater than the first activation pressure. Thereby, the complementary valve (100) ensures that the pressure activated device (200, 300) is reset after use.

5 Claims, 3 Drawing Sheets

(56) References Cited

U.S. PATENT DOCUMENTS 3,559,734 A * 2/1971 Pitts ..... E21B 17/14 137/512.3
4,441,552 A * 4/1984 Hamman ..... E21B 23/06 166/120
4,646,829 A * 3/1987 Barrington ..... E21B 23/006 166/125
5,890,540 A * 4/1999 Pia ..... E21B 21/10 166/321
6,289,990 B1 * 9/2001 Dillon ..... E21B 34/08 166/319
7,766,084 B2 * 8/2010 Churchill ..... E21B 21/103 137/115.03
9,562,418 B2 * 2/2017 Osborne ..... E21B 34/08
9,683,424 B2 * 6/2017 Cleven ..... E21B 33/124
2003/0111236 A1 * 6/2003 Serafin ..... E21B 23/06 166/387
2004/0129423 A1 * 7/2004 Eddison ..... E21B 21/103 166/321
2007/0246265 A1 * 10/2007 deBoer ..... E21B 21/10 175/318
2009/0025930 A1 * 1/2009 Iblings ..... E21B 19/16 166/244.1
2009/0211814 A1 * 8/2009 de Boer ..... E21B 21/10 175/57
2010/0282476 A1 * 11/2010 Tessier ..... E21B 34/08 166/373
2011/0155379 A1 * 6/2011 Bailey ..... E21B 19/16 166/324
2011/0315390 A1 * 12/2011 Guillory ..... E21B 21/103 166/329
2012/0199210 A1 * 8/2012 Osborne ..... E21B 34/08 137/1
2012/0261127 A1 * 10/2012 Zhou ..... E21B 21/103 166/289
2013/0319767 A1 * 12/2013 Wilson ..... E21B 21/10 175/24
2016/0230507 A1 * 8/2016 Cleven ..... E21B 33/124
2016/0362961 A1 * 12/2016 Andrew ..... E21B 33/12
2017/0254171 A1 * 9/2017 Cleven ..... E21B 34/14
2017/0342788 A1 * 11/2017 Wesson ..... E21B 4/02
2018/0298726 A1 * 10/2018 Mailand ..... E21B 34/102
2018/0313188 A1 * 11/2018 Antonsen ..... E21B 34/10

* cited by examiner

METHODS AND SYSTEMS FOR A COMPLEMENTARY VALVE

BACKGROUND

Field of the Invention

The present invention concerns a complementary valve for a wellbore application.

Prior and Related Art

As the term is used herein, a "wellbore" is a borehole fully or partially lined with a steel casing. The wellbore extends into an underground geological formation from a surface on dry land or the seafloor, and the steel casing is typically cemented to the surrounding geological formation. Such wellbores are used in numerous applications. Examples include, but are not limited to, production wells for producing hydrocarbons from underground reservoirs or for geothermal applications and injection wells for enhanced oil recovery or for permanent storage of $CO_2$. Hydraulic fracturing is one example of a wellbore application.

In the following description and claims, the bore pressure is an absolute pressure within a central bore through a string, and the ambient pressure is an absolute pressure outside the string. When the string is inserted into a wellbore, the ambient pressure equals the wellbore pressure or annulus pressure. In contrast to these absolute pressures, i.e. pressures measured relative to vacuum, activation pressures and injection pressures are to be construed as pressures relative to ambient pressure. Thus, the term "activation pressure" as used herein means bore pressure minus ambient pressure, not the difference to atmospheric pressure or some other reference. Similarly, the term "injection pressure", as used herein, means the difference between the bore pressure and the ambient pressure.

Hydraulic fracturing is an example of a wellbore application suitable for the present invention. Hydraulic fracturing essentially involves inserting a hollow string into the wellbore, setting packers upstream and downstream of an injection zone, opening an injection valve in the string and injecting a slurry of liquid and solid particles into the injection zone isolated by the packers. The injection pressure is sufficient to enlarge cracks in the formation and force particles into the cracks. The particles, e.g. sand or artificial ceramic particles, remain in the cracks and keeps them open when the bore pressure decreases to permit a fluid flow from the formation through the enlarged cracks into a production string.

Fracturing and other high-pressure injections may cause loss of fluid to the formation so that the wellbore pressure after injection becomes less than the wellbore pressure before the injection. Thus, the pressure difference after injection may be greater than the difference before injection, and the greater difference may exceed the first activation pressure. In other words, the pressure difference after injection may keep a pressure activated device, e.g. a packer or a valve, in its activated state when the borehole pressure decreases to the level at which the pressure activated device was activated.

Traditionally, a drop in ambient pressure has been handled by equalizing the pressures inside and outside the string by leaving an injection valve open, e.g. by using shear pins for activation, or by using burst discs to provide an open fluid path through the string wall.

Devices using burst discs and/or shear pins may, at least in principle, be used several times. However, such devices must be retrieved and repaired before they can be used at a new location. For various reasons, e.g. low product price, a desire to exploit marginal fields and/or reservoirs with multiple zones, it is desirable or required to treat several zones in one trip, i.e. without withdrawing and reinserting the string for each zone.

An example of an apparatus suitable for repeated hydraulic fracturing and other high pressure applications during one trip can be found in our co-pending Norwegian patent application NO 20150182 A1, which concerns an apparatus with a normally closed injection valve disposed between an upstream packer and a downstream packer. In use, the packers are set upstream and downstream from the zone to be treated, e.g. fractured. The packers are set by increasing the bore pressure to a first activation pressure. Similarly, the injection valve opens at a second activation pressure to permit a radial flow of fluid into the formation. The second activation pressure for the injection valve may be equal to or greater than the first activation pressure to ensure the packers are set before injection commences.

When the injection is complete, the bore pressure is decreased. At the second activation pressure, a spring returns a sliding sleeve in the injection valve to its closed position. This prevents pressure equalization between the central bore and the wellbore. When the bore pressure drops to the value at which the packers were set, the packers may remain set if the ambient pressure has decreased such that the difference between bore pressure and ambient pressure exceeds the first activation pressure.

These packers and injection valves are examples of pressure activated devices that are activated by an activation pressure, i.e. a difference between bore pressure and ambient pressure according to the definition above. In general, such a pressure activated device comprises a shear pin, a spring or some other activation element providing an activation force that must be overcome to activate the device. A desired activation force is set by selecting an appropriate shear pin or spring, and possibly by adjusting the extension or compression of the spring. An activation pressure works on a net piston area to overcome the activation force, and is adapted to the activation force by adjusting the net piston area. The description of a pressure activated device is intentionally general, and any pressure activated device fitting the description can be used with the present invention.

While a spring is the preferred activation element in devices designed to be used multiple times during one trip, shear pins or the like are not excluded. Regardless of application or activation element, resetting an assembly of several pressure activated devices involves decreasing the activation pressure to below the first activation pressure, i.e. the lowest activation pressure associated with the pressure activated devices in the application at hand.

NO 20150182 A1 described above also describes a bottom valve located within the central bore downstream from the downstream packer. The bottom valve is normally open to allow circulation through the central bore during run-in. At a predetermined flow, the bottom valve closes. Once the bottom valve closes, the internal pressure can rise to set the packers and open the injection valve to permit a radial fluid flow into the formation.

The bottom valve is activated by a pressure drop caused by an increased flow velocity. However, this flow induced pressure drop may be considerably less than the activation pressure required to set packers, e.g. 50 bar or above. A distinction is made between a "pressure activated device" and a "flow activated device" for ease of description.

The objective of the present invention is to ensure that a pressure activated device is reset when the ambient pressure drops after operation, e.g. due to loss into the formation.

SUMMARY OF THE INVENTION

This objective is achieved with a complementary valve according to claim 1.

More particularly, the invention provides a complementary valve for a movable string in a wellbore application, wherein the movable string comprises a flow activated valve configured to open when a flow through a central bore is less than a predetermined threshold and to close if the flow exceeds the threshold. The string also comprises a pressure activated device configured to be activated when an activation pressure, defined as the difference between a bore pressure within the central bore and an ambient pressure around the string, is greater than or equal to a first activation pressure and to be deactivated when the activation pressure is less than the first activation pressure. The complementary valve is configured to open a fluid connection between the central bore and the ambient wellbore if the activation pressure is less than the first activation pressure and to close the fluid connection when the activation pressure is equal to or greater than the first activation pressure.

In use, the string inserted into the wellbore. When the string moves along the wellbore, a flow less than the predetermined threshold may pass through the central bore. Once the flow exceeds the predetermined threshold, the flow activated valve closes such that the bore pressure may increase. As the bore pressure increases past the first activation pressure, the pressure activated device activates, and the complementary valve closes. This allows a further increase of bore pressure in order to activate devices at higher pressures, e.g. open an injection valve at a second activation pressure. Later, when the bore pressure decreases past the first activation pressure, the complementary valve opens to equalize the pressures inside and outside the string. Thus, any forces keeping the pressure activated device activated are neutralized. When the flow drops below the predetermined threshold, the flow activated valve opens, and the process may be repeated.

In a preferred embodiment, the complementary valve comprises a sliding sleeve with a piston area exposed to the central bore, wherein the piston area is configured to provide a force in a downstream direction toward a closed position. As the force is directed downstream, the piston area may be regarded as a net piston area. Alternative valves could comprise any another mechanism, a sensor, a control unit and an actuator working on the mechanism in response to an input from the sensor. However, such alternatives are expected to be complex, impractical and expensive.

In the preferred embodiment, a spring exerts a spring force on the sliding sleeve in an upstream direction toward an open position. Preferably, the spring force from a compressible spring in its most extended state is approximately equal to the first activation pressure acting on the piston area. Then, the complementary valve closes at about the first activation pressure, i.e. as soon as the activation pressure overcomes the minimum spring force. The spring force increases as the spring is compressed, and should be configured such that the spring starts opening the valve at any probable loss of ambient pressure as described.

The preferred embodiment further comprises a restricted passage to the outside such that the sliding sleeve returns to its open position within a few minutes. The restricted passage provides reduced pressure to part of the sliding sleeve such that the bore pressure exerts a net closing force on the sliding sleeve. The restriction should preferably provide a delay of a few minutes before the complementary valve opens. In general, a delay is not mandatory as there are known alternative means to avoid pressure transients and/or dampen those that may occur. The fluid flowing through the central bore may also be replaced without stopping the pumps.

In some embodiments, the complementary valve comprises threads at a downstream end that are complementary to threads at an upstream end of the flow activated valve. In this manner, a range of flow activated valves may conveniently be combined with a range of complementary valves in a versatile system.

In alternative embodiments, the flow activated valve can be an integrated part of a downstream end of the complementary valve to provide a compact unit that is easily attached to the end of the string. If so, the flow activated valve part of the assembly preferably comprises an axially movable poppet designed to block a restricted passage running axially through the downstream end.

Further features and benefits will become clear from the detailed description.

BRIEF DESCRIPTION OF THE DRAWINGS

The invention will be explained by means of an exemplary embodiment with reference to the drawings, in which:

FIG. 1 illustrates an assembly of pressure activated devices during run-in;

FIG. 3 is a longitudinal cross section of a valve assembly during run-in;

DETAILED DESCRIPTION

The drawings illustrate the principles of the invention, and are not necessarily to scale. For the same reason, numerous details known to one of ordinary skill in the art are omitted from the drawings and the following description.

Figure 1:
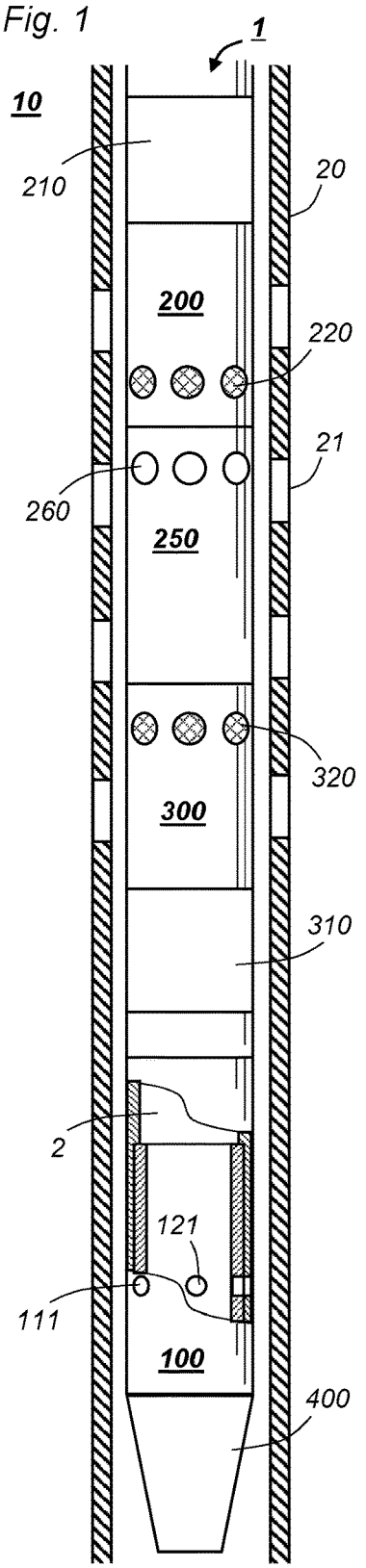
Figure 2:
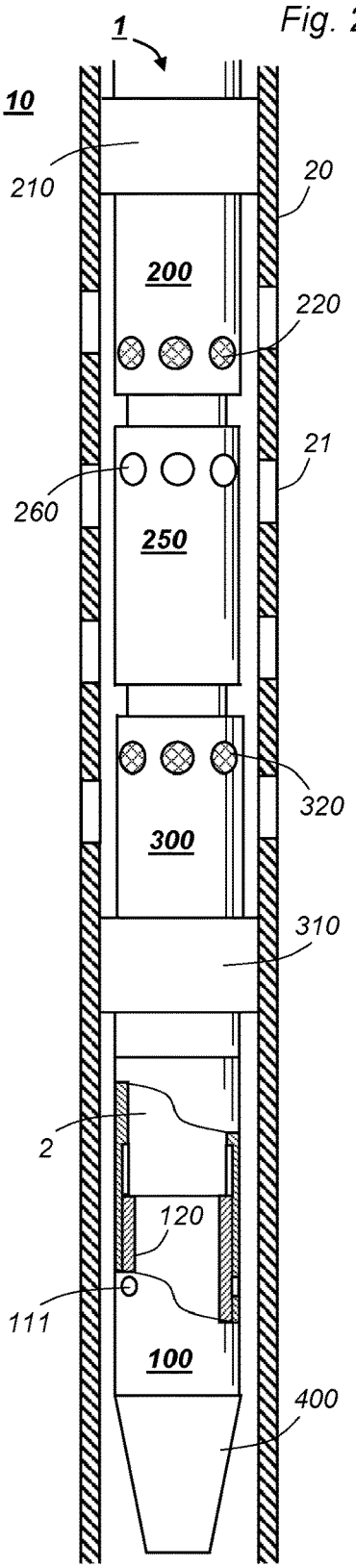
FIG. 2 shows the assembly from FIG. 1 during operation.

FIGS. 1 and 2 illustrate an example of a wellbore application wherein a string 1 is inserted into a casing 20 in some wellbore application. The casing 20 is cemented to a formation 10, and has perforation holes 21 for injection, e.g. fracturing or re-fracturing. The string 1 comprises three pressure activated devices: an upstream packer 200, an injection valve 250 and a downstream packer 300. A complementary valve 100 according to the invention is located downstream from the downstream packer 300, and a flow activated valve 400 ends the string 1.

Pumps at the surface (not shown) provide fluid at a bore pressure through a central bore 2 within the string 1. FIG. 1 illustrates the state when the string 1 is moved in the wellbore, e.g. during run-in. In this state, the packers 200, 300 are not set, the injection valve 250 is closed and the complementary valve 100 is open.

The packer 200 comprises a packer element 210, which is an elastic cylinder configured to expand radially when compressed axially. A filter 220 provides fluid communication between the wellbore and the interior of the packer 200. The packer 200 is operated by an activation pressure defined as the difference between the bore pressure and the ambient pressure, which is provided through the filter 220.

The downstream packer 300 is designed similar to the upstream packer 200, and comprises a packer element 310 and a filter 320. In the embodiment shown in FIGS. 1 and 2, the packers 200 and 300 are oriented in opposite directions, so that the filters 220, 320 are closer to the injection valve 250 than the respective packer elements 210 and 310. This limits the length of the assembly of packers 200, 300 and injection valve 250. The minimum length of the assembly is determined by the length of the injection zone, i.e. the axial length of the region with perforation holes 21.

The injection valve 250 is a normally closed sliding sleeve valve with radial ports 260. The packers 200, 300 should be set before injection. Specifically, the packer elements 210, 310 should be expanded into contact with the wellbore wall, as illustrated in FIG. 2, before the injection valve 250 opens and injection starts. The packer elements 210, 310 expand at a first activation pressure, and the injection valve 250, typically a sliding sleeve design, opens at a second activation pressure, which is equal to or greater than the first activation pressure. In FIG. 1, both activation pressures are relative to one common wellbore pressure. Thus, a higher activation pressure implies a higher bore pressure.

The complementary valve 100 is specified by well known functions. For example, it is required to open at the first activation pressure defined above. Therefore, any design that fulfils this requirement may be used, including complex designs with a feedback loop. However, the complementary valve 100 is conveniently designed with a sliding sleeve 120 that keeps the valve open when radial ports 121 through the sliding sleeve 120 are aligned with radial ports 111 through the wall of a housing. Such a sliding sleeve valve is illustrated in a cutaway portion of the string 1 in FIGS. 1 and 2. In the closed state shown in FIG. 2, the radial ports 121 through the sliding sleeve 120 are axially displaced from the ports 111.

In principle, the open ports 111, 121 may be large enough to permit a significant amount of fluid to circulate down the central bore 2, through the radial ports 111, 121 and back through the annular space between the string 1 and the casing 20. Thus, in principle, the string 1 may be closed at its downstream end. However, the bore pressure must be increased to a first activation pressure in order to expand the packer elements 210, 310 to the inner wall of casing 20, so there must be some flow activated valve to stop the circulation and start building up the bore pressure. While it is entirely possible to provide a pressure drop over the ports 111, 121, large ports 111, 121 are difficult to combine with throttling to limit fluid flow. Hence, a practical embodiment will most likely include a separate flow activated valve 400 downstream from the complementary valve 100 as shown.

Once the bottom valve 400 closes, the bore pressure rises fast and closes the complementary valve 100, sets the packers 200, 300 and opens the injection valve 250 during a short time interval. This may cause pressure transients that, if unhandled, might open the complementary valve 100, and thereby reset the packers 200, 300 and the injection valve 250. Means for avoiding and/or damping pressure transients are well known, and not described further herein. However, the opening of the complementary valve 100 is preferably delayed by a few periods to prevent any transients from opening the complementary valve 100 before the pressure stabilizes. This is further described below.

Figure 3:
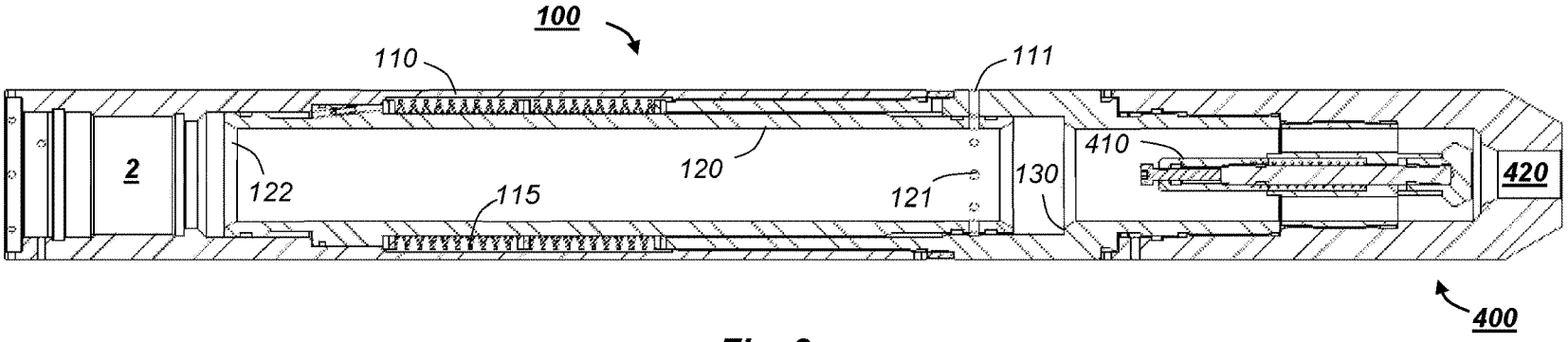

FIGS. 3-6 show the complementary valve 100 and the bottom valve 400 in greater detail. FIG. 3 illustrates a state during run-in corresponding to the state in FIG. 1. In this state, a poppet 410 is axially retracted from a restricted passage 420 through the downstream end of the string. When the poppet 410 is retracted, the bottom valve 400 allows an axial flow of fluid from the surface through the central bore 2 and into the wellbore. According to Bernoulli's principle, an increased flow velocity through the restricted passage 420 causes an increased pressure drop. The poppet 410 is preferably spring loaded, so that the pressure drop must overcome a spring force before the poppet 410 is pulled into the closed position shown in FIG. 4. In other words, the geometry and spring force may be adjusted to close the bottom valve 400 at a predetermined threshold flow.

Figure 4:
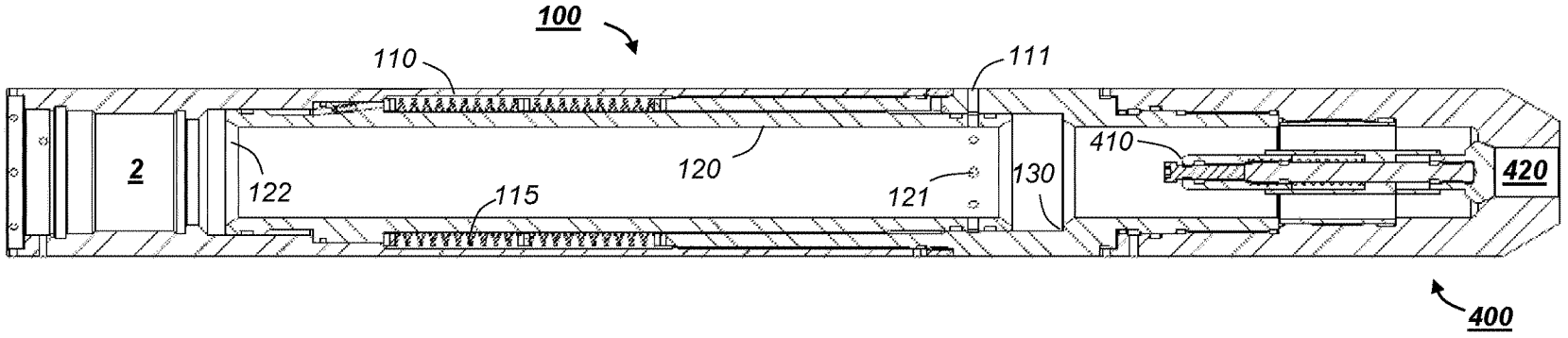
FIG. 4 shows the valve assembly from FIG. 3 with a closed bottom valve.

FIG. 4 illustrates a state where the poppet 410 blocks the axial flow through the central bore 2, e.g. as a spherical surface on the poppet 410 engages a funnel shaped surface at the entrance to the restricted passage 420. When the bottom valve 400 is closed, the bore pressure may start to increase. As in FIG. 3, the ports 111 and 121 are aligned. The combined area of radial ports 111, 121 should be sufficiently small to allow the activation pressure to reach the first activation pressure in order to expand packer elements 210, 310 to the wellbore wall (FIG. 2) and shift the sliding sleeve 120 to its closed position.

Figure 5:
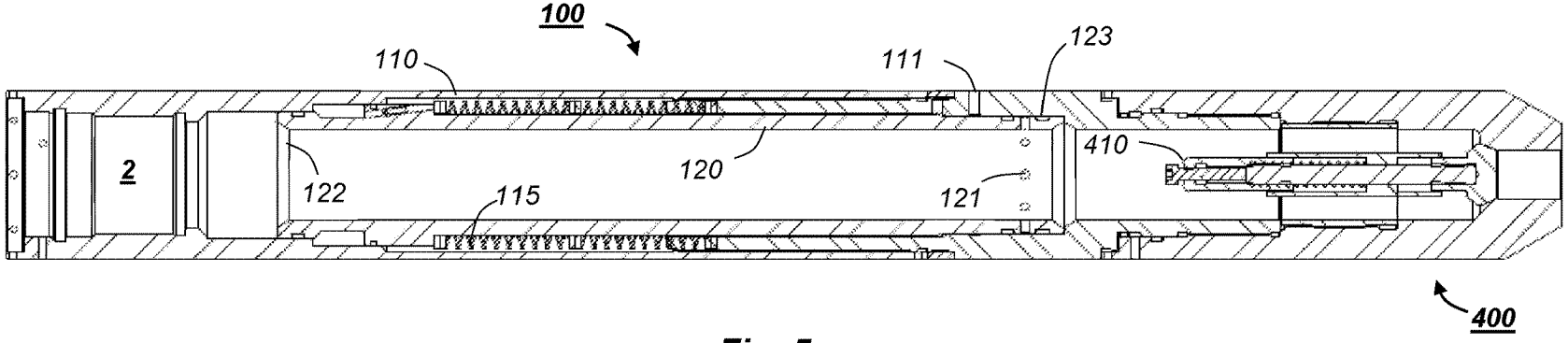
FIG. 5 shows the valve assembly from FIG. 3 during operation.

In FIG. 5, the sliding sleeve 120 has shifted downstream against the spring force from spring 115, thereby displacing the radial ports 121 from the ports 111 and closing the complementary valve 100. The net piston area 122 and spring force from spring 115 should be configured such that the sliding sleeve 120 shifts downstream at the first activation pressure. A stopping shoulder 130 stops the axial motion of the sliding sleeve 120.

Seals 123, e.g. O-rings, upstream and downstream from the radial ports 121 seal against the inner wall of housing 110 to allow a further increase of bore pressure. In the example illustrated in FIGS. 1 and 2, this increased pressure sets the packers 200, 300 firmly and opens the injection valve 250.

The wellbore pressure may be lower after the injection than before the injection, e.g. due to loss of fluid into the formation. Thus, the difference between bore pressure and ambient pressure after injection may exceed the first activation pressure even if the bore pressure is the same as before injection. In other words, the reduced ambient pressure may prevent the packers 200, 300 and other pressure activated devices from resetting.

As the bore pressure decreases further to normal circulation pressure, i.e. the bore pressure in the state illustrated in FIG. 1, the bore pressure may still force the poppet 410 against the seat in passage 420 due to a reduced ambient pressure. Without the complementary valve 100, the only way of opening the flow activated valve 400 would be to reduce the bore pressure further until the difference between bore pressure and ambient pressure can be overcome by a poppet spring or the like in the flow activated valve 400. This would require precise control of the pumps on the surface and possibly downhole sensors and a control system to prevent wellbore fluid from flowing into the central bore.

The complementary valve 100 resolves this hydraulic lock if the spring force from spring 115 is sufficiently strong to open the valve. In particular, the extra spring force provided by the extra compression of the spring 115 should shift the sliding sleeve 120 from the closed position in FIG. 5 to the open position in FIG. 6.

A restricted passage 112 provides fluid communication between the wellbore and a small downstream piston area on the sliding sleeve 120. The purpose is to provide a net pressure force working on the larger piston area 122 against the spring force from spring 115, and thereby delay the shift of sliding sleeve 120 from the position in FIG. 5 to the position in FIG. 6.

A suitable delay, e.g. 2-5 minutes, should prevent that pressure transients caused by closing the string opens the complementary valve and resets the packers etc. The delay may also allow temporary stop of circulation, e.g. as a source for circulation fluid is replaced by one for injection fluid at the surface. When the complementary valve 100 has been open for a while, the pressure provided through the restricted passage 112 will approach the wellbore pressure, not a reduced pressure due to a throttle effect through the restricted passage 112.

Figure 6:
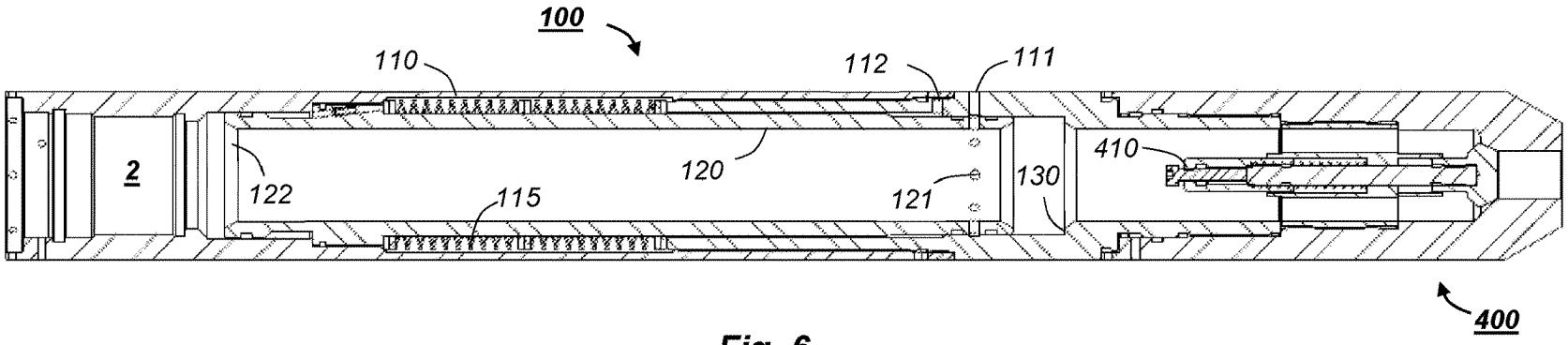
FIG. 6 shows the valve assembly from FIG. 3 during release.

FIG. 6 illustrates a state where the flow activated valve 400 is still locked due to loss of ambient pressure, whereas the complementary valve 100 is open due to the reduced bore pressure. In this state, the bore pressure equalizes to the ambient pressure through the ports 111, 121. When the bore pressure is sufficiently close to the new ambient pressure, the flow activated valve 400 opens, and the process of moving the string while circulating fluid through the central bore, setting packers etc. may be repeated.

As indicated above, an injection valve 250 located between packers 200, 300 may be adapted for different kinds of injection. Thus, the invention may obviously be used for wellbore applications other than hydraulic fracturing or re-fracturing. Moreover, wellbore applications with one or more than two packers wherein a hydraulic lock like one described with reference to FIG. 6 are obviously possible. Furthermore, assemblies where the packers are replaced with one or more swabs may encounter similar problems. The flow activated valve 400 may be integrated into the complementary valve 100. For example, the assembly illustrated in FIGS. 3-6 may be regarded as a single unit. The skilled person also knows several equivalents to the individual parts illustrated and described above. Thus, the scope of the invention is only limited by the appended claims.

The invention claimed is:

1. A tool for use in a wellbore application comprising:

a flow activated valve configured to be in an opened position when a flow through a central bore is less than a predetermined threshold and to be in a closed position if the flow exceeds the predetermined threshold, and a packer configured to be activated when a responsive to a pressure differential being greater than or equal to a first activation pressure threshold^ and the packer is configured to be deactivated responsive to the pressure differential being less than the first activation pressure threshold, wherein the pressure differential is associated with a bore pressure within the central bore and an ambient pressure within an annulus outside of a moveable string, wherein the annulus is positioned between casing and an outer surface of the moveable string;

a radial valve configured to open a fluid connection between the central bore and the annulus responsive to the pressure differential being less than the first activation pressure threshold, and to close the fluid connection between the central bore and the annulus responsive to the pressure differential being equal to or greater than the first activation pressure threshold, the radial valve including first radial ports extending through a housing and second radial ports extending through a sliding sleeve, wherein the first radial ports and the second radial ports are aligned when the radial valve is opened, and the first radial ports and the second radial ports are misaligned when the radial valve is closed, the radial valve being positioned more proximate to the flow activated valve than the packer.

2. The tool according to claim 1, wherein the sliding sleeve comprises a piston area exposed to the central bore, wherein the piston area is configured to provide a force in a direction towards the flow activated valve.

3. The tool according to claim 2, wherein a spring exerts a spring force on the sliding sleeve in a direction away from the flow activated valve.

4. The tool according to claim 1, wherein the flow activated valve is an integral part of a distal end of the tool.

5. The tool according to claim 4, wherein the flow activated valve comprises:

an axially movable poppet designed to block a restricted passage running axially through the downstream end.

* * * * *